US012331642B1

(12) United States Patent
Wang et al.

(10) Patent No.: US 12,331,642 B1
(45) Date of Patent: Jun. 17, 2025

(54) COMPOSITE SUPPORTING STRUCTURE COMBINING FABRIC-FORM BAG-BEHIND-WALL GROUTING AND HIGH-STRENGTH SUPPORT FRAMES, AND CONSTRUCTION METHOD THEREOF

(71) Applicant: SHANDONG JIANZHU UNIVERSITY, Jinan (CN)

(72) Inventors: Jun Wang, Jinan (CN); Jianping Zuo, Jinan (CN); Hougang Ding, Jinan (CN); Xiao Lv, Jinan (CN); Jiepeng Tian, Jinan (CN)

(73) Assignee: SHANDONG JIANZHU UNIVERSITY, Jinan (CN)

( * ) Notice: Subject to any disclaimer, the term of this patent is extended or adjusted under 35 U.S.C. 154(b) by 0 days.

(21) Appl. No.: 19/099,804

(22) PCT Filed: Aug. 2, 2023

(86) PCT No.: PCT/CN2023/110823

§ 371 (c)(1),
(2) Date: Jan. 30, 2025

(87) PCT Pub. No.: WO2024/027772

PCT Pub. Date: Feb. 8, 2024

(30) Foreign Application Priority Data

Aug. 3, 2022 (CN) ..... 202210927132.3

(51) Int. Cl.
*E21D 11/00* (2006.01)
*E21D 11/10* (2006.01)

(52) U.S. Cl.
CPC ..... *E21D 11/107* (2013.01); *E21D 11/006* (2013.01)

(58) Field of Classification Search
CPC ..... E21D 11/086; E21D 11/10; E21D 11/107; E21D 11/006
See application file for complete search history.

(56) References Cited

U.S. PATENT DOCUMENTS 4,120,164 A * 10/1978 Tomlin ..... E21D 11/157 405/289
6,761,504 B1 * 7/2004 Brandenberger ..... E21F 16/02 405/150.2

(Continued)

FOREIGN PATENT DOCUMENTS

CN 101493012 A 7/2009
CN 101725362 A 6/2010

(Continued)

*Primary Examiner* — Benjamin F Fiorello
(74) *Attorney, Agent, or Firm* — IPRO, PLLC; Na Xu

(57) ABSTRACT

The present invention provides a composite supporting structure combining fabric-form bag-behind-wall grouting and high-strength support frames and a construction method thereof, relating to the field of underground engineering support. The composite supporting structure comprises multiple sections of composite supporting units sequentially arranged in a longitudinal direction, wherein each of the composite supporting units comprises support frame, circumferential fabric-form bags are arranged outside top plate sections and side sections of the support frames, and longitudinal fabric-form bags and longitudinal supports are arranged in an alternating manner outside bottom plate sections of the support frames. The present invention forms an active-passive combined full-section composite high-strength supporting structure that may solve the problems of support difficulties such as high ground pressure, strong disturbance and the like of deep wells.

6 Claims, 4 Drawing Sheets

(56) References Cited

U.S. PATENT DOCUMENTS

| | | | | |
|---|---|---|---|---|
| 10,865,641 | B1 * | 12/2020 | Yin | E21D 21/006 |
| 2019/0071968 | A1 * | 3/2019 | Chen | E21D 11/105 |
| 2020/0263542 | A1 * | 8/2020 | Mulvoy | E21D 5/12 |

FOREIGN PATENT DOCUMENTS

| | | | |
|---|---|---|---|
| CN | 105298514 | A | 2/2016 |
| CN | 106677797 | A | 5/2017 |
| CN | 108457668 | A | 8/2018 |
| CN | 108930542 | A | 12/2018 |
| CN | 110645018 | A | 1/2020 |
| CN | 110700863 | A | 1/2020 |
| CN | 112983509 | A | 6/2021 |
| CN | 113137242 | A | 7/2021 |
| CN | 214464209 | U | 10/2021 |
| CN | 114776323 | A | 7/2022 |
| CN | 114776330 | A | 7/2022 |
| DE | 3730574 | A1 | 3/1989 |

* cited by examiner

COMPOSITE SUPPORTING STRUCTURE COMBINING FABRIC-FORM BAG-BEHIND-WALL GROUTING AND HIGH-STRENGTH SUPPORT FRAMES, AND CONSTRUCTION METHOD THEREOF

The present invention claims priority benefits to Chinese Patent Application number 202210927132.3, entitled "A COMPOSITE SUPPORTING STRUCTURE COMBINING FABRIC-FORM BAG-BEHIND-WALL GROUTING AND HIGH-STRENGTH SUPPORT FRAMES, AND A CONSTRUCTION METHOD THEREOF", filed on Aug. 3, 2022, with the China National Intellectual Property Administration (CNIPA), the entire contents of which are incorporated herein by reference.

TECHNICAL FIELD

The invention relates to the field of underground engineering support, in particular to a composite supporting structure combining fabric-form bag-behind-wall grouting and high-strength support frames, and a construction method thereof.

BACKGROUND

It is difficult to stabilize tunnels excavated under complex geological conditions such as deep soft rocks and faults with a single support. The simple bolting-steel mesh-shotcreting support or U-shaped steel support cannot meet the requirements of support stability. Prestressed anchor cable support technology has been promoted and used in mining areas where it is difficult to implement support. In some mines, the support effect is good, while in some mines, the effect is poor. Concrete arch support is used more in key chambers, but binding steel bars and pouring concrete on site leads to slow construction speed, slow growth of concrete strength, and cracks easily occur during the age, thus reducing the overall bearing capacity of concrete arch.

At present, the bolting-steel mesh-shotcreting support is commonly used in deep tunnels, which is, firstly installing anchor rods, followed by laying steel mesh and spraying concrete, and then, based on the bolting-steel mesh-shotcreting support, erecting rigid supports or pouring concrete arch bodies. This active-passive coupling support method has low bearing capacity, and the sprayed concrete is a brittle support body that is prone to cracking to pieces after compression. In addition, on-site binding of steel bars and pouring of concrete result in slow construction speed, slow growth of concrete strength, and easy cracking during the aging period, thereby reducing the overall bearing capacity of the concrete arch.

SUMMARY

Aiming at the defects existing in the prior art, the present invention aims to provide a composite supporting structure combining fabric-form bag-behind-wall grouting and high-strength support frames, and a construction method thereof, so as to form an active-passive combined full-section composite high-strength supporting structure, and solve the problems of support difficulties such as high ground pressure, strong disturbance and the like of deep wells.

In order to achieve the above object, the present invention is achieved through the following technical solutions.

In a first aspect, an example of the present invention provides a composite supporting structure combining fabric-form bag-behind-wall grouting and high-strength support frames, comprising multiple sections of composite supporting units sequentially arranged along a longitudinal direction of a tunnel, each of the composite supporting units comprises support frames, wherein circumferential fabric-form bags are arranged outside top plate sections and side sections of the support frames, and longitudinal fabric-form bags and longitudinal supports are arranged in an alternating manner outside bottom plate sections of the support frames.

As a further implementation mode, two layers of reinforcing steel mesh sheets are respectively arranged in the circumferential fabric-form bags and the longitudinal fabric-form bags, and the two layers of the reinforcing steel mesh sheets are connected to each other through first high-strength fiber bundles.

As a further implementation mode, adjacent circumferential fabric-form bags are connected by second high strength fiber bundles, and the circumferential fabric-form bags, the longitudinal fabric-form bags respectively are connected to the support frames by the second high strength fiber bundles.

As a further implementation mode, adjacent support frames are connected to each other by a plurality of connecting rods arranged at intervals along a circumferential direction of the tunnel.

As a further implementation mode, the circumferential fabric-form bags are arranged between a bolting-steel mesh-shotcreting support and the support frames, and a fabric-form bag-grouting reinforced concrete structure is formed by pouring concrete into the circumferential fabric-form bags and the longitudinal fabric-form bags.

As a further implementation mode, the each of the composite supporting units is provided with a plurality of anchor rods in the circumferential direction of the tunnel.

As a further implementation mode, the longitudinal supports are of U-shaped steels, and the support frames are of a concrete-filled steel tube support frame.

In a second aspect, an example of the present invention further provides a construction method of a composite supporting structure combining fabric-form bag-behind-wall grouting and high-strength support frames, comprising:

- drilling and inserting bolts around a tunnel, and forming a temporary support by using a bolting-steel mesh-shotcreting support;
- laying longitudinal supports, then laying longitudinal fabric-form bags between the longitudinal supports;
- erecting bottom plate sections of support frames, installing side sections and top plate sections of the support frames, and connecting adjacent support frames by using a plurality of connecting rods;
- laying circumferential fabric-form bags, then grouting the circumferential fabric-form bags, the longitudinal fabric-form bags and the support frames respectively;
- connecting adjacent circumferential fabric-form bags, the circumferential fabric-form bags, the longitudinal fabric-form bags and the support frame respectively through second high-strength fiber bundles, to form a composite supporting structure.

As a further implementation, the circumferential fabric-form bags are fixed to a surrounding rock by short nails.

As a further implementation, finally backfilling a bottom plate by using gangue or waste ballast.

The beneficial effects of the present invention are as follows:

(1) According to the present invention, the composite supporting structure is composed of groutable circumferential fabric-form bags, longitudinal fabric-form bags and concrete-filled steel tube support frames, which improves the overall support force of tunnels under conventional support conditions and effectively inhibits the deformation of the tunnels; the fabric-form bags are matched with U-shaped steels, concrete-filled steel tube support frames, connecting rods and second high-strength fiber bundles to further strengthen the support strength.

(2) According to the present invention, the adjacent fabric-form bags, the fabric-form bags and the concrete-filled steel tube support frames are connected by using second high-strength fiber bundles, and the concrete-filled steel tube support frames are connected by connecting rods, so that acting force may be transmitted to the two adjacent concrete-filled steel tube support frames through the connecting rods, thereby increasing the overall bearing capacity of the support frames, and simultaneously, the fabric-form bags and the concrete-filled steel tube support frames may be well connected together, so that the fabric-form bag-behind-wall grouting and the high-strength supports are combined into a composite high-strength supporting structure.

(3) According to the present invention, the upper and lower layers of reinforcing steel mesh sheets are arranged in the fabric-form bags, and there is a certain interval between the reinforcing steel mesh sheets and an interior of the fabric-form bags. The upper and lower layers of the reinforcing steel mesh sheets are connected by the first high-strength fiber bundles, and a thickness during concrete-pouring may also be controlled by the first high-strength fiber bundles, thus enhancing the bearing capacity of the fabric-form bags; the fabric-form bags are convenient to process and install, and template support is not required during construction, thus greatly saving material and labor costs.

BRIEF DESCRIPTION OF THE DRAWINGS

The accompanying drawings constituting a part of the present invention are used to provide a further understanding of the present invention. The exemplary examples of the present invention and descriptions thereof are used to explain the present invention, and do not constitute an improper limitation of the present invention.

Figure 1:
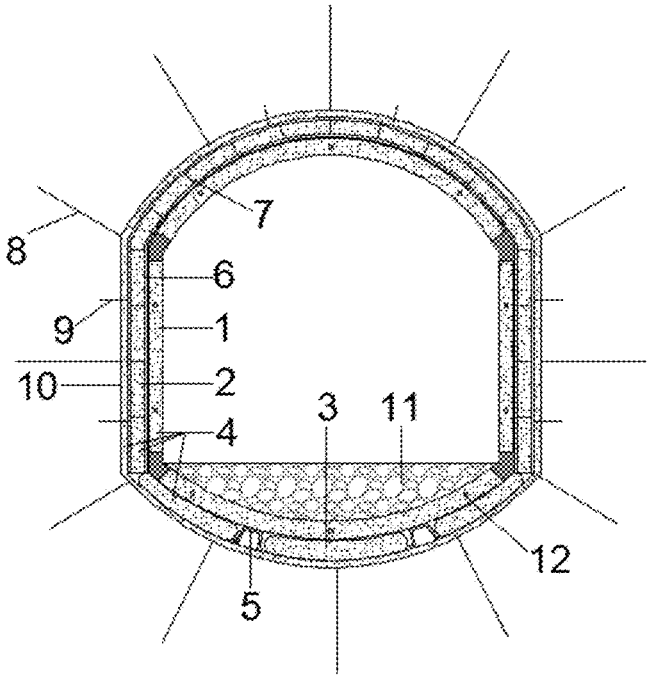
FIG. 1 is a plan view of a composite supporting structure according to one or more examples of the present invention.

In the drawings, 1—support frame, 2—circumferential fabric-form bag, 3—longitudinal fabric-form bag, 4—concrete, 5—longitudinal support, 6—steel mesh sheet, 7—first high-strength fiber bundle, 8—anchor rod, 9—short nail, 10—steel mesh sheet, 11—waste ballast, 12—connecting rod, 13—second high-strength fiber bundle.

DETAILED DESCRIPTION

Example 1

Figure 3:
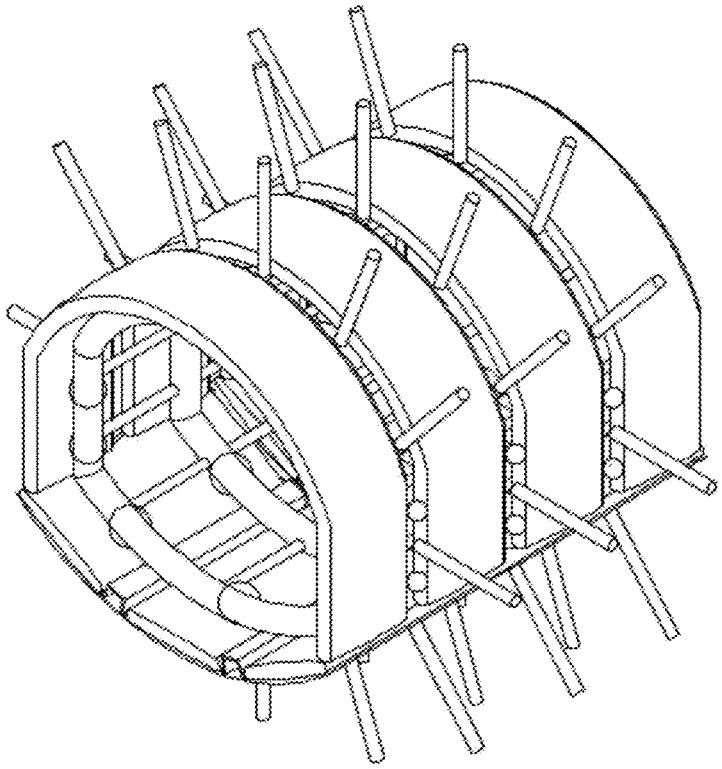
FIG. 3 is a structural diagram of multiple sections of the composite supporting unit according to one or more examples of the present invention.

The present example provides a composite supporting structure combining fabric-form bag-behind-wall grouting and high-strength support frames, as shown in FIG. 1 and FIG. 3, comprising multiple sections of composite supporting units sequentially arranged along a longitudinal direction of a tunnel, each of the composite supporting units comprises support frames 1, circumferential fabric-form bags 2 and longitudinal fabric-form bags 3, wherein the support frames 1 are of a concrete-filled steel tube support frame, and an enclosed structure at an outer side of the concrete-filled steel tube support frame is formed by the circumferential fabric-form bags 2 and the longitudinal fabric-form bags 3.

Figure 2:
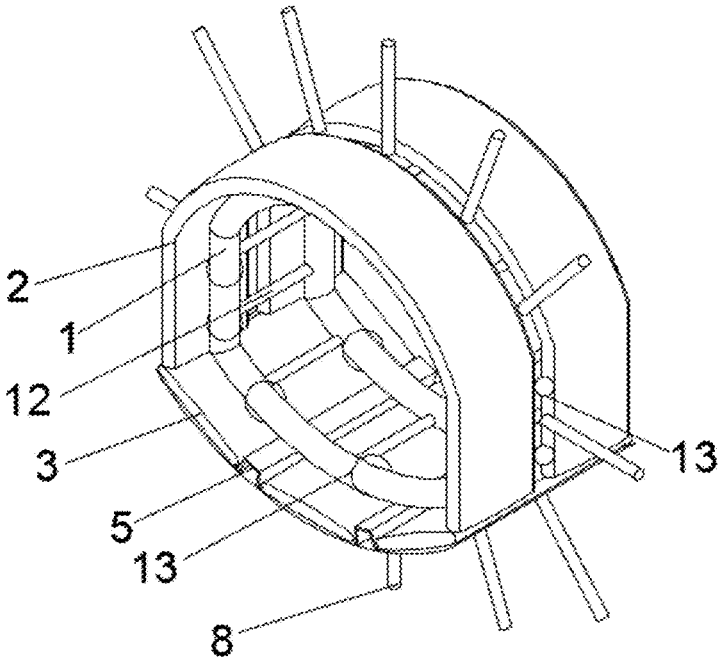
FIG. 2 is a structural diagram of a composite supporting unit according to one or more examples of the present invention.

Specifically, as shown in FIG. 2, in the each of the composite supporting units, one support frame 1 is assembled and formed by four sections of a bottom plate section, side sections and a top plate section; the circumferential fabric-form bags 2 are arranged outside top plate sections and side sections of the concrete-filled steel tube support frames; the longitudinal fabric-form bags 3 are arranged outside bottom plate sections of the support frames; longitudinal supports 5 are arranged between adjacent longitudinal fabric-form bags 3, and the longitudinal supports 5 are of U-shaped steels in the present example.

An shape, thickness, length and the like of the circumferential fabric-form bags 2 and the longitudinal fabric-form bags 3 are designed according to an overall support force of the tunnel and the actual situation; the fabric-form bags are convenient to process and install during construction, template support is not needed during construction, and the material and labor cost are greatly saved.

In the present example, the each of the composite supporting units is provided with two concrete-filled steel tube support frames, and adjacent concrete-filled steel tube support frames are connected by connecting rods 12; the plurality of the connecting rods 12 are arranged at intervals along a circumferential direction of the adjacent concrete-filled steel tube support frames, so that the acting force may be transmitted to the two concrete-filled steel tube support frames through the connecting rods 12. The each of the concrete-filled steel tube support frames corresponds to one circumferential fabric-form bag 2, and ends of two circumferential fabric-form bags 2 are connected through the longitudinal fabric-form bags 3.

It may be understood that other arrangements of the support frames 1, the circumferential fabric-form bags 2 and the longitudinal fabric-form bags 3 may be used.

Figure 6:
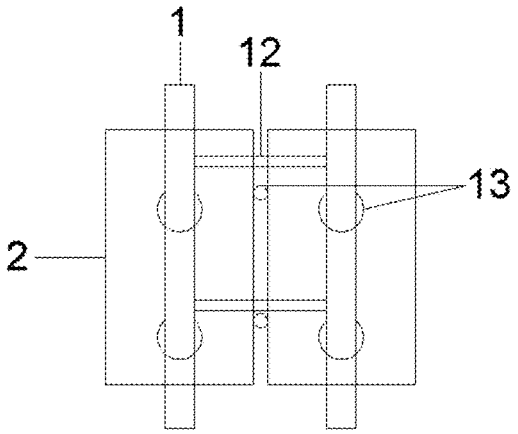
FIG. 6 is a schematic diagram of a connection of the fabric-form bags and support frames according to one or more examples of the present invention.

As shown in FIG. 3 and FIG. 6, the adjacent fabric-form bags, the fabric-form bags and the concrete-filled steel tube support frames are connected by second high-strength fiber bundles 13 respectively, i.e., between the adjacent circumferential fabric-form bags 2, and between the circumferential fabric-form bags 2, the longitudinal fabric-form bags 3 and the concrete-filled steel tube support frames are connected by the second high-strength fiber bundles 13.

The second high-strength fiber bundles 13 are configured to be acid resistant, corrosion resistant, good in insulation property, not easy to age, and strong in bearing force; and fabric-form bags-behind-wall are connected with the high-strength support frames (concrete-filled steel tube support frames) through a cooperation of the second high-strength fiber bundles 13 and the connecting rods 12 to form a composite high-strength integral supporting structure.

Figure 4:
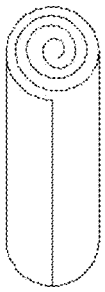
FIG. 4 is a schematic diagram of a fabric-form bag of a single roll prior to bag grouting according to one or more examples of the present invention.
Figure 5:
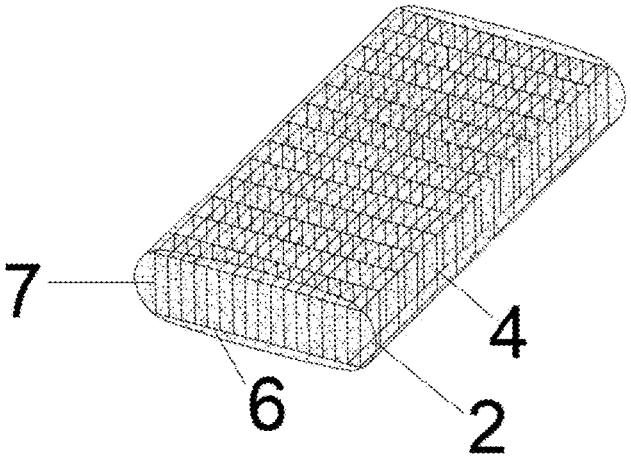
FIG. 5 is a structural diagram of an interior of the fabric-form bag after the bag grouting according to one or more examples of the present invention.

As shown in FIG. 4, the fabric-form bag is of a roll-shaped high-fiber flexible supporting structure before use. Taking the longitudinal fabric-form bag 3 as an example, a state thereof after grouting is shown in FIG. 5. Two layers of upper and lower steel mesh sheets 6 are arranged in the fabric-form bag. There is a certain interval between the steel mesh sheets 6 and the interior of the fabric-form bag. The upper and lower steel mesh sheets 6 are connected by first high-strength fiber bundles 7. The first high-strength fiber bundles 7 may also be used to control the thickness of the fabric-form bag during filling.

The fabric-form bags are positioned between a bolting-steel mesh-shotcreting support and the concrete-filled steel tube support frames, concrete 4 is poured in the fabric-form bags to form a fabric-form bag-grouting reinforced concrete structure, so the template support may be not needed during construction, and construction efficiency is improved; the fabric-form bag-grouting reinforced concrete supporting structure adopts grouting forming, so that the construction is simple and fast; and the fabric-form bag-grouting reinforced concrete supporting structure may adapt to various complex terrains, may provide strong support force, and effectively inhibits deformation of a tunnel.

Figure 7:
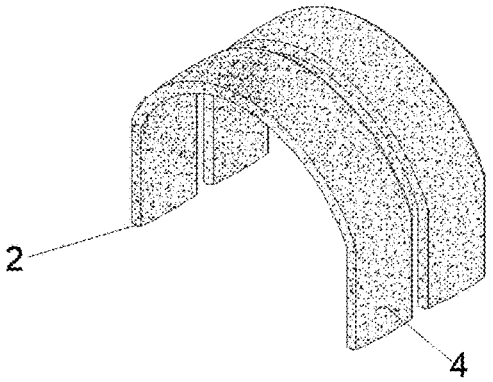
FIG. 7 is a schematic diagram of arrangement of circumferential fabric-form bags according to one or more examples of the present invention.

The arrangement mode of the fabric-form bags of the present example is divided into an upper circumferential arrangement and a bottom longitudinal arrangement, as shown in FIG. 7, the upper circumferential arrangement is performed by first erecting side sections and top plate sections of the support frames, then fixing the circumferential fabric-form bags 2 on the surrounding rock by short nails 9, and then grouting the circumferential fabric-form bags 2, which may provide support force for the sides and the top plates of the tunnel.

Figure 8:
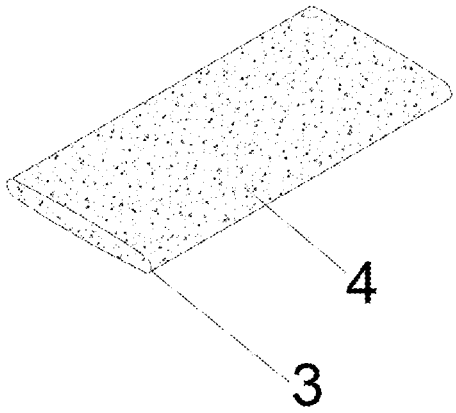
FIG. 8 is a schematic diagram of a single longitudinal fabric-form bag according to one or more examples of the present invention.
Figure 9:
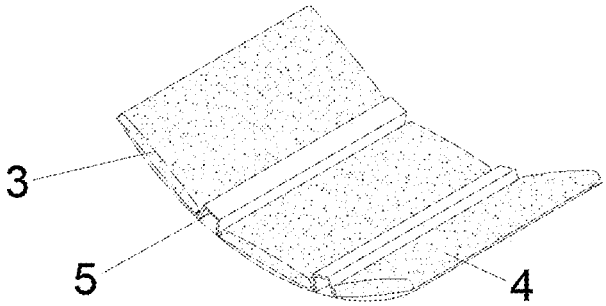
FIG. 9 is a schematic diagram of arrangement of the longitudinal fabric-form bags and longitudinal supports according to one or more examples of the present invention.

As shown in FIGS. 8 to 9, the bottom longitudinal arrangement is performed by first laying longitudinal U-shaped steels to support the steel support frames, then laying the longitudinal fabric-form bags 3 between the U-shaped steels, and then grouting the longitudinal fabric-form bags 3, so the support force of the bottom plate of the tunnel may be provided; the composite integral high-strength full-supporting structure is formed by the upper circumferential arrangement and the bottom longitudinal arrangement.

During construction, the tunnel is excavated and formed, and a temporary support is performed by using the bolting-steel mesh-shotcreting support, i.e., anchor rods 8 are drilled and inserted first, and then steel mesh sheet 10 is laid and the concrete is grouted. The purpose of the temporary support is to ensure the stability of construction space in a short time. Then, the longitudinal U-shaped steels are first laid, and the longitudinal fabric-form bags 3 are laid between the longitudinal U-shaped steels, to form the bottom plate; the bottom plate sections of the support frames are erected, and the side sections and the top plate sections of the support frames are installed.

The support frame 1 is assembled and formed by four sections of a bottom plate section, side sections and a top plate section, and the adjacent support frames 1 are connected by connecting rods 12; the circumferential fabric-form bags 2 are positioned between the bolting-steel mesh-shotcreting support and the concrete-filled steel tube support frames, and are fixed on the surrounding rock by short nails 9.

The adjacent fabric-form bags are connected by the second high strength fiber bundles 13; the concrete-filled steel tube support frames are connected to the fabric-form bags through the second high strength fiber bundles 13 at a rear side of the fabric-form bags, so that the fabric-form bags and the concrete-filled steel tube support frames are matched with the second high strength fiber bundle 13 to form a high strength composite support integral structure, the overall support force is enhanced, effectively inhibiting the integral deformation and damage of the tunnel influenced by mining.

The bolting belongs to an active support and may fully mobilize the bearing capacity of deep surrounding rock, but has poor whole space coordination and limited support force; the fabric-form bag-behind-wall grouting and the high-strength support frames belong to a passive support, have high radial support force, but large rigidity to non-contractible, and poor dynamic pressure disturbance resistance; according to the present example, the full-section composite high-strength supporting structure may be formed through the active-passive support combination, and the problems of difficult support such as high pressure and strong disturbance in deep wells may be solved.

Example 2

The present example provides a method of constructing a composite supporting structure combining fabric-form bag-behind-wall grouting and high-strength support frames, as shown in FIG. 1, comprising:

- step 1: carrying out a bolting-steel mesh-shotcreting support for a temporary support, wherein a purpose of the temporary support is to ensure the stability of construction space in a short time; then carrying out an excavation of an inverted arch;
- step 2: first laying longitudinal U-shape steels on a position of the inverted arch, and then laying longitudinal fabric-form bags 3 between the longitudinal U-shaped steels;
- step 3: erecting bottom plate sections of support frames, then installing side sections and top plate sections of the support frames;
- step 4; laying circumferential fabric-form bags 2 with built-in steel mesh sheets 6 outside the support frames 1, connecting the steel mesh sheets 6 by using first high-strength fiber bundles 7, and connecting adjacent steel support frames by using connecting rods 12;
- step 5: grouting the fabric-form bags and the steel support frames respectively, and connecting adjacent grouted fabric-form bags, the grouted fabric-form bags to the concrete-filled steel tube support frames by using second high-strength fiber bundles 13; and
- step 6: backfilling a bottom plate with gangue or waste ballast 11.

In the present example, the main parameters that need to be determined according to the different conditions such as tunnel buried depth, geological conditions, ground stress and lithology, as well as the actual situation of the site include: the thickness, length, strength and curvature of the fabric-form bag, the concrete-filled steel tube support frame, the U-shaped steel and the connecting rod, the density of the steel mesh, the anchor rod type and the spacing, etc.

The foregoing descriptions are merely preferred embodiments of the present invention but are not intended to limit the present invention. A person skilled in art may make various alterations and variations to the present invention. Any modification, equivalent replacement, or improvement made within the spirit and principle of the present invention shall fall within the protection scope of the present invention.

The invention claimed is:

1. A composite supporting structure combining fabric-form bag-behind-wall grouting and high-strength support frame, comprising multiple sections of composite supporting units sequentially arranged along a longitudinal direction, each of the composite supporting units comprises support frames, wherein circumferential fabric-form bags are arranged outside top plate sections and side sections of the support frames, and longitudinal fabric-form bags and longitudinal supports are arranged in an alternating manner outside bottom plate sections; the circumferential fabric-form bags and the longitudinal fabric-form bags form an enclosed structure outside the support frames; each of the support frames corresponds to one circumferential fabric-form bag, and ends of two circumferential fabric-form bags are connected to each other through one longitudinal fabric-form bag; adjacent support frames are connected to each other through a plurality of connecting rods arranged at intervals along a circumferential direction;

wherein, the circumferential fabric-form bags are arranged between a bolting-steel mesh-shotcreting support and the support frames; a fabric-form bag-grouting reinforced concrete structure is formed by pouring concrete into the circumferential fabric-form bag and the longitudinal fabric-form bags; and two layers of reinforcing steel mesh sheets are respectively arranged in the circumferential fabric-form bags and the longitudinal fabric-form bags, and the two layers of the reinforcing steel mesh sheets are connected to each other through first high-strength fiber bundles; adjacent circumferential fabric-form bags are connected, the circumferential fabric-form bags, the longitudinal fabric-form bags and the support frame are connected respectively by second high strength fiber bundles.

2. The composite supporting structure combining fabric-form bag-behind-wall grouting and high-strength support frames according to claim 1, wherein the each of the composite supporting units is provided with a plurality of anchor rods in a circumferential direction.

3. The composite supporting structure combining fabric-form bag-behind-wall grouting and high-strength support frames according to claim 1, wherein the longitudinal supports are of U-shaped steels, and the support frames are a concrete-filled steel tube support frame.

4. A construction method of a composite supporting structure combining fabric-form bag-behind-wall grouting and high-strength support frames, comprising:

drilling and inserting bolts around a tunnel, and carrying out a temporary support by using a bolting-steel mesh-shotcreting support;

laying longitudinal supports and laying longitudinal fabric-form bags between the longitudinal supports;

erecting bottom plate sections of support frames, installing side sections and top plate sections of the support frames, and connecting adjacent support frames by connecting rods;

laying circumferential fabric-form bags, and grouting the circumferential fabric-form bags, the longitudinal fabric-form bags and the support frames, respectively; and connecting adjacent circumferential fabric-form bags, connecting the circumferential fabric-form bags, the longitudinal fabric-form bags and the support frames respectively by second high-strength fiber bundles, to form a composite supporting structure.

5. The construction method of the composite supporting structure combining fabric-form bag-behind-wall grouting and high-strength support frames according to claim 4, wherein the circumferential fabric-form bags are fixed to a surrounding rock by short nails.

6. The construction method of the composite supporting structure combining fabric-form bag-behind-wall grouting and high-strength support frames according to claim 4, wherein finally backfilling a bottom plate with gangue or waste ballast.

* * * * *